US005390760A

United States Patent [19]

Murphy

[11] Patent Number: 5,390,760

[45] Date of Patent: Feb. 21, 1995

[54] SAFETY GUARD FOR SCISSOR LIFT

[75] Inventor: Alan E. Murphy, Kingsburg, Calif.

[73] Assignee: UpRight, Inc., Selma, Calif.

[21] Appl. No.: 226,763

[22] Filed: Apr. 12, 1994

[51] Int. Cl.[6] ..... E04B 1/20

[52] U.S. Cl. ..... 182/113; 782/63

[58] Field of Search ..... 182/113, 63, 141, 148

[56] References Cited

U.S. PATENT DOCUMENTS 2,948,363 8/1960 Hopfeld ..... 182/141

5,154,569 10/1992 Eryon et al. ..... 182/141

5,310,018 5/1994 Lahaie ..... 182/113

*Primary Examiner*—Alvin C. Chin-Shue

[57] ABSTRACT

A movable safety guard mechanism for use with a motorized scissor lift is provided. The guard mechanism includes two side assemblies which pivot about a point carried on the chassis of the lift. As the work platform is raised, the side assemblies move outwardly and, when the lift is lowered to its lowermost position, the side assemblies are pulled inwardly to a position adjacent the scissor lift.

5 Claims, 3 Drawing Sheets

SAFETY GUARD FOR SCISSOR LIFT

BACKGROUND AND BRIEF SUMMARY OF THE INVENTION

This invention pertains in general to a safety guard for use with a motorized scissor lift. In particular, the present invention provides a movable safety guard for a motorized scissor lift. When the scissor lift is in its lowermost position, the guard is held closely against the sides of the lift to allow the lift to pass through doorways and the like. As the scissor lift is actuated and begins to rise, the safety guard moves away from the lift mechanism to allow the lift to be elevated to a desired working level.

Stationary safety guards have been used in the prior art in conjunction with scissor lifts. However, the stationary safety guards must be designed to allow clearance between the guard and the lift mechanism. This clearance adds to the overall width of the machine and restricts the doorways through which the machines may pass. The present invention avoids that problem by the use of a movable safety guard which is held tightly against the sides of the lift when the scissor lift mechanism is in its lowermost position. In this position, the motorized lift may pass through a doorway (or other limited clearance passageway) with minimum side clearance as well as minimum overhead clearance.

A primary object of the invention is to provide a movable safety guard for a motorized scissor lift which reduces the effective width of the machine in its lowermost position to allow it to pass through relatively narrow doorways and access ways.

A further object of the invention is to provide a movable safety guard mechanism for a scissor lift wherein the guard automatically moves from its closed to its open position when the lift is lowered and raised.

A further object of the invention is to provide a movable guard mechanism which is simple in design and extremely dependable.

Other objects and advantages of the invention will become apparent from the following description of the preferred embodiments and the accompanying drawings wherein:

DETAILED DESCRIPTION OF THE DRAWINGS

Figure 1:
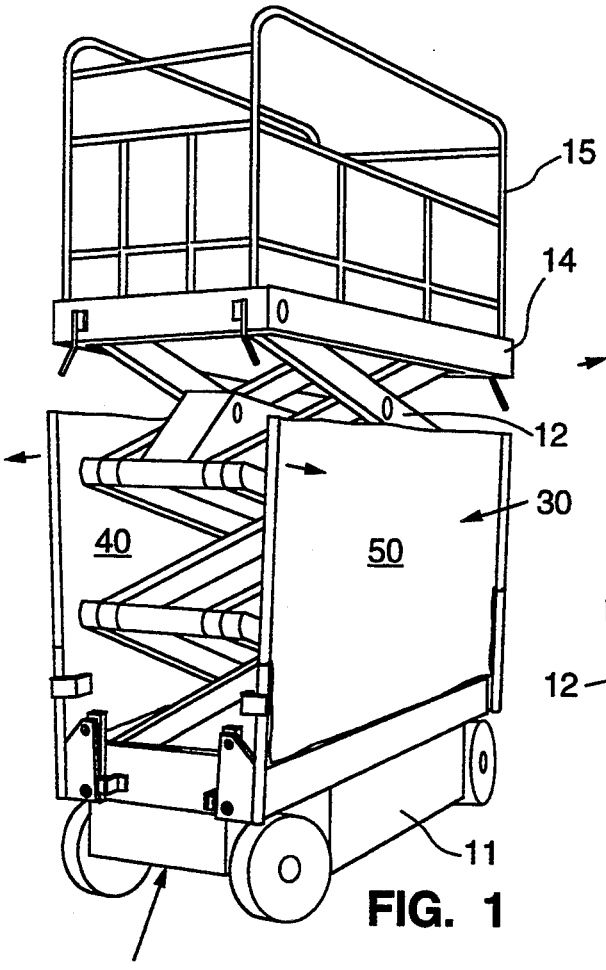
FIG. 1 is a perspective view of a motorized scissor lift in an elevated position using one embodiment of the safety guard according to the present invention.
Figure 2:
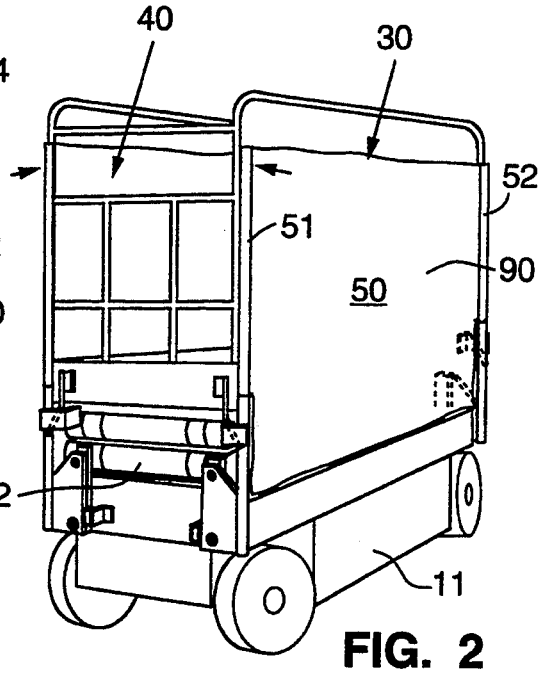
FIG. 2 is a perspective view of the apparatus of FIG. 1 wherein the scissor lift mechanism is at its lowermost position and the safety guard mechanism is in its inner position where it is held adjacent the sides of the lift.

As shown in FIGS. 1 and 2, a motorized scissor lift shown generally as 10 has a wheeled chassis 11 and a scissor lift mechanism 12 carried by the chassis. A work platform 14 is carried by the scissor lift mechanism 12. Safety rails 15 are carried by platform 14. As shown in FIG. 2, the scissor lift mechanism 12 has been lowered to a first, lowermost position wherein the motorized lift is most easily driven through doorways and areas with restricted overhead and side clearance.

The movable safety guard mechanism referred to generally as 30 comprises a first side assembly 40 and a second side assembly 50. Side assembly 50 has two posts 51 and 52 which extend upwardly to a height which equals or is greater than the height of the scissor lift mechanism when the work platform 14 is in its first and lowermost position shown in FIG. 2. The safety guard mechanism 30 is intended to prevent injury by persons having arms or fingers caught in the scissor lift as the lift is being lowered.

Figure 3:
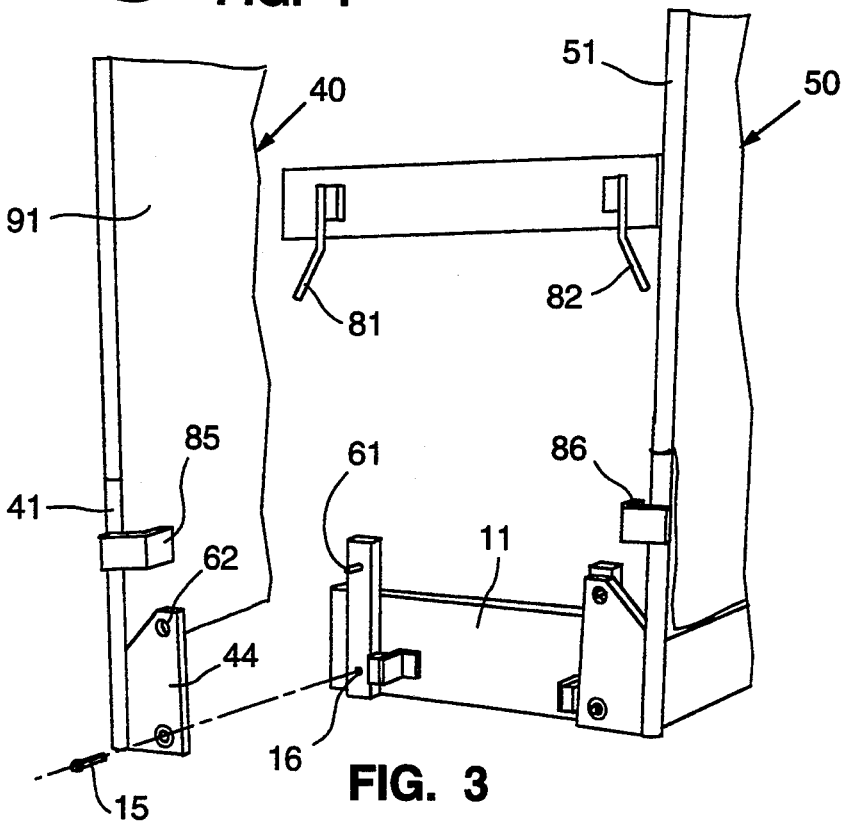
FIG. 3 is a perspective and partially exploded view of a portion of the apparatus shown in FIGS. 1 and 2.
Figure 6:
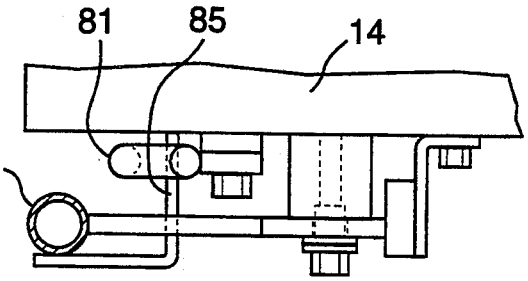
FIG. 6 is section on the line 6—6 of FIG. 5.
Figure 4:
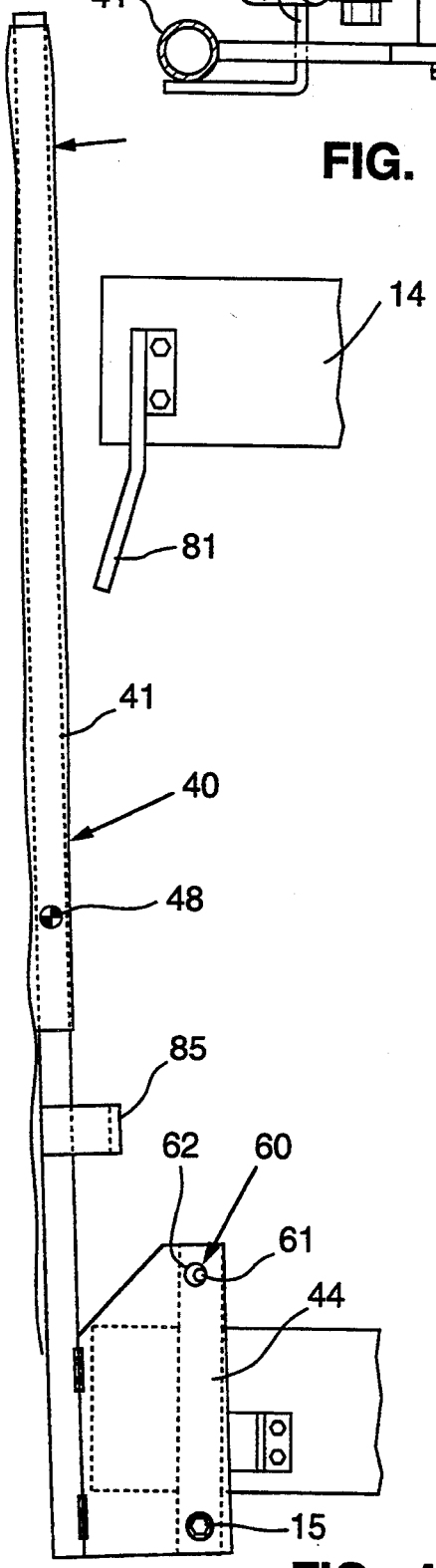
FIG. 4 is a side elevational view of the guard mechanism shown in FIG. 3 wherein the platform is elevated and the guard is in its outer position.

As shown best in FIG. 3, post 41 is carried by the chassis 11 by a pin 15 extending through bracket 44, which allows post 41 to pivot around point 16 on chassis 11. Bracket 44 is attached rigidly to post 41. Post 41 has a center of gravity at approximately point 48 shown on FIG. 4. Since the center of gravity 48 is located outwardly of pivot point 15, gravity tends to pull post 41 to the left in FIG. 4 as shown by the directional arrow near the top of post 41.

A limit means 60 is connected to side assembly 40 to restrict the outward travel of the side assembly. Limit means 60 comprises a stop 61 (FIG. 3) which is a cylindrical shaft extending horizontally from chassis 11 and extends through a passageway 62 formed in bracket 44. As shown best in FIG. 4, as post 41 is pulled outwardly by gravity, the side wall of passageway 62 contacts the stop 61 and prevents the post 41 from moving any further outwardly.

Figure 5:
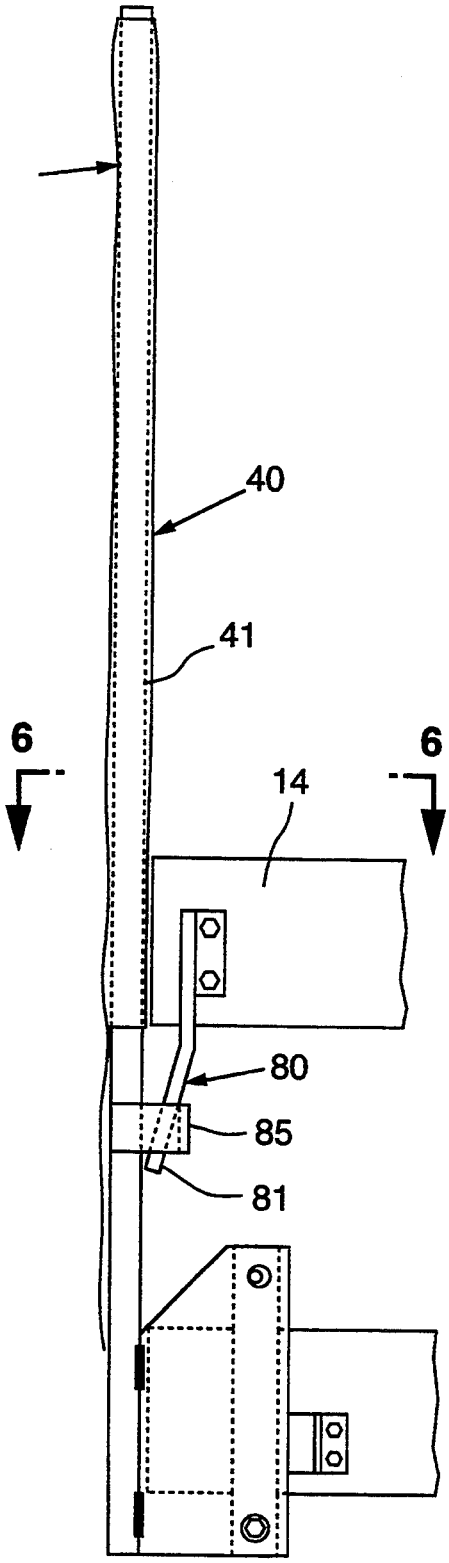
FIG. 5 is a side elevational view of the apparatus shown in FIGS. 3 and 4 wherein the platform is in its lowermost position and the guard has been pulled into its inner position adjacent the lift.

A retraction means shown generally as 80 is provided to pull side assembly 40 inwardly as the platform 14 is lowered to its lowermost position as shown in FIG. 5. Retraction means 80 comprises a pair of fingers 81 and 82 carried by platform 14, each finger extending downwardly and outwardly below said platform. Retraction means 80 also includes a pair of L-shaped brackets 85 and 86 carried by side assemblies 40 and 50, respectively. The L-shaped brackets engage the fingers 81 and 82 as the platform 14 approaches its lowermost position and, as the platform reaches its lowermost position, the fingers have pulled the side assemblies inwardly to a position adjacent the platform 14 and the scissor lift mechanism 12, as shown by FIGS. 2 and 5.

Side assembly 50 has a flat membrane 90 which extends between the posts 51 and 52 and which physically prevents persons from reaching inwardly toward the scissor lift mechanism 12. Side assembly 40 also has a similar membrane 91 extending between posts 41 and 42.

Similar membranes, not shown in the drawings, to membranes 90 and 91 are provided across the front and rear to enclose the front and rear portions of the scissors lift 12.

Figure 7:
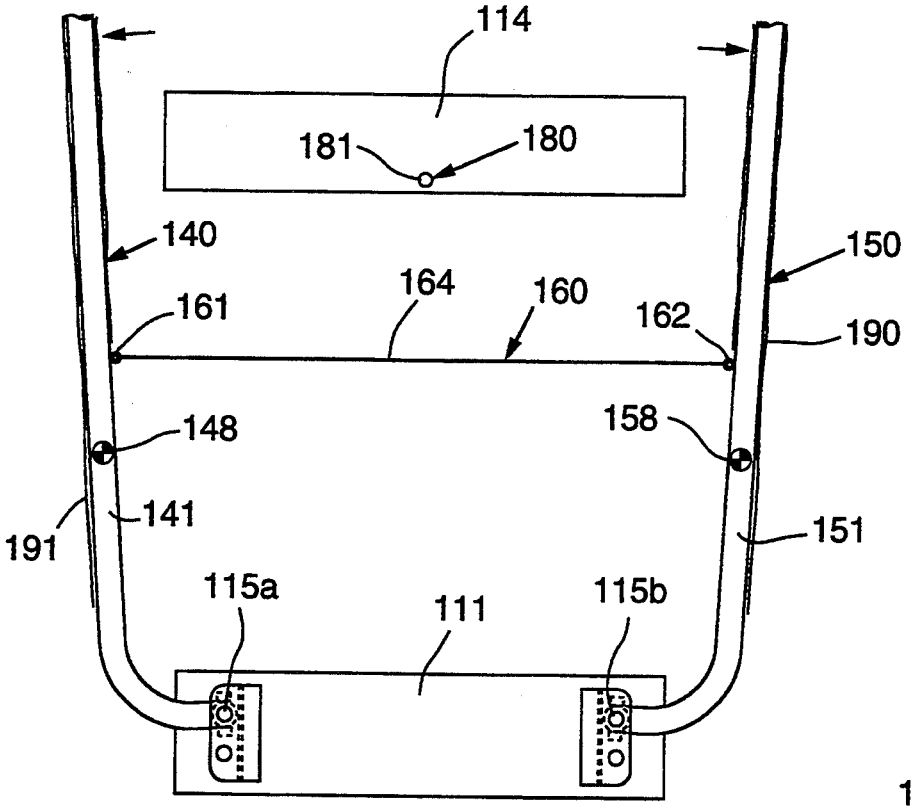
FIG. 7 is a side elevational view of an alternate embodiment of the invention showing the work platform in elevated position and the side assemblies in their outward position.
Figure 9:
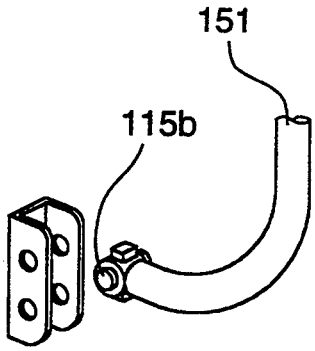
FIG. 9 is a perspective view of a portion of the apparatus shown in FIGS. 7 and 8.
Figure 8:
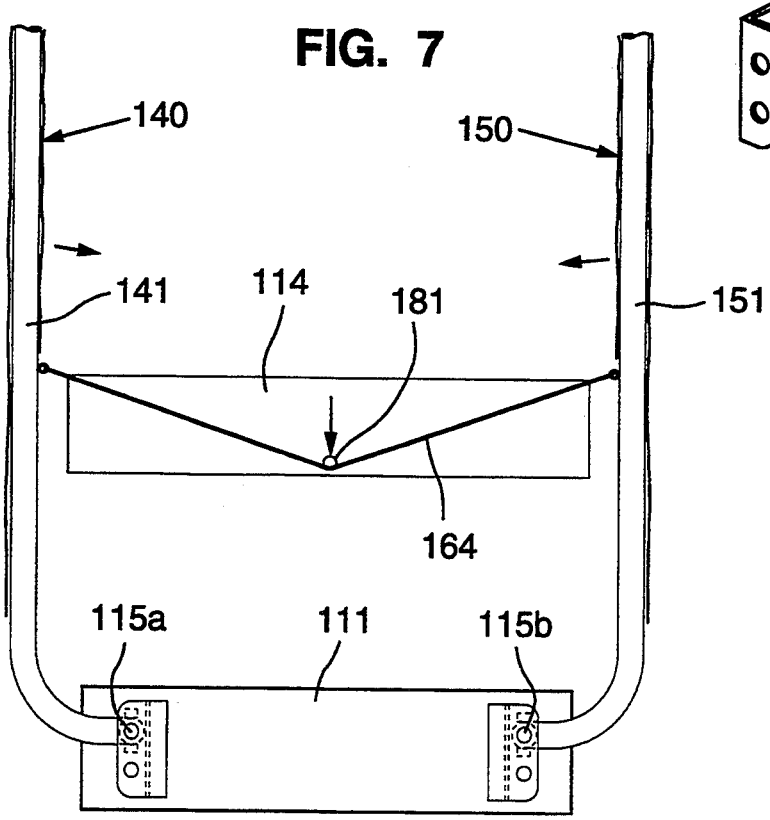
FIG. 8 is a side elevational view of the apparatus shown in FIG. 7 wherein the work platform is in its lowermost position and the side assemblies have been drawn into their inner position.

FIGS. 7–9 show an alternate embodiment of the invention. The reference numerals shown on FIGS. 7–9 are three-digit numerals wherein the last two numerals correspond to similar components shown in FIGS. 1–5.

FIG. 7 shows side assemblies 140 and 150 in their outer position. Posts 141 and 151 are connected to chassis 111 at pivots 115*a* and 115*b*. Posts 141 and 151 have centers of gravity approximately at points 148 and 158 which lie outwardly of pivots 115*a* and 115*b*.

Limit means 160 comprises a steel cable connected to post 141 by connector 161 and to post 151 by connector 162. Steel cable 164 is of an appropriate length that, when the posts 141 and 151 have rotated outwardly to the desired position for adequate clearance from platform 114, the cable 164 has been pulled taught.

Retraction means 180 comprises a pin 181 carried by work platform 114. Pin 181 engages the cable 164 as the platform 114 approaches its lowermost position and cable 164 is pulled taught and, in turn, pulls the side assemblies 140 and 150 inwardly to a position adjacent the platform 114 and the scissor lift mechanism (not shown in FIGS. 7–9) as the platform reaches its lowermost position shown in FIG. 8. In the embodiment shown in FIGS. 7–9, side assembly 140 has two identical posts, one carried by the front of chassis 11 and the other covered by the rear of chassis 11, in similar fashion to the embodiment shown in FIGS. 1–5. Similarly, side assembly 150 includes two posts. Membranes 190 and 191 are utilized to enclose the side assemblies. Membranes 190 and 191 may be a variety of flexible material such as canvas or plastic.

What is claimed is:

1. A safety guard mechanism for use in conjunction with a motorized scissor lift, the lift having a chassis and a scissor lift mechanism carried by said chassis, wherein a work platform carried by the scissor lift mechanism may be lowered to a first, lowermost position or elevated to a plurality of different heights by activating the scissor lift mechanism, said guard mechanism being movable from an inner position in which the guard mechanism is held adjacent the scissor lift mechanism when the platform is in its lowermost position, to an outer position wherein the guard mechanism is moved away from the scissor lift as the scissor lift is raised, the guard mechanism comprising:

first and second side assemblies wherein each side assembly is carried by said chassis at two or more pivot points, each side assembly having at least two posts which extend upwardly to a height which equals or is greater than the height of said scissor lift mechanism when said work platform is in its first, lowermost position, each of said posts having a center of gravity which is located outwardly of said pivot points so that gravity tends to pull each side assembly away from said scissor lift mechanism, limit means connected to said first and second side assemblies to restrict the outward travel of each side assembly, and retraction means for pulling said side assemblies inwardly as said platform is lowered to its lowermost position.

2. The apparatus of claim 1 wherein said limit means comprises a cable extending between and connecting both side assemblies.

3. The apparatus of claim 2 wherein said retraction means comprises a pin carried by said work platform, said pin engaging said cable as said platform is moved downwardly toward its lowermost position, whereby said cable is pulled taught and in turn pulls said side assemblies inwardly as said platform reaches its lowermost position.

4. The apparatus of claim 1 wherein said limit means comprises a bracket carried by each side assembly and a stop carried by said chassis, said stop limiting the motion of said bracket.

5. The apparatus of claim 1 wherein said retraction means comprises a pair of fingers carried by said platform, each finger extending downwardly and outwardly below said platform, L-shaped brackets carried by each side assembly for engaging said fingers as said platform is moved to its lowermost position whereby as said platform reaches its lowermost position, said fingers have pulled each side assembly inwardly to a position adjacent said scissor mechanism.

* * * * *